US009169641B2

(12) United States Patent
Wickstrom

(10) Patent No.: US 9,169,641 B2
(45) Date of Patent: Oct. 27, 2015

(54) CLEANROOM WALL PANEL SYSTEM, AND METHOD

(71) Applicant: Benjamin D. Wickstrom, Grand Rapids, MI (US)

(72) Inventor: Benjamin D. Wickstrom, Grand Rapids, MI (US)

(73) Assignee: Erhardt Construction Company, Ada, MI (US)

( * ) Notice: Subject to any disclaimer, the term of this patent is extended or adjusted under 35 U.S.C. 154(b) by 0 days.

(21) Appl. No.: 14/326,559

(22) Filed: Jul. 9, 2014

(65) Prior Publication Data

US 2015/0020468 A1 Jan. 22, 2015

Related U.S. Application Data

(60) Provisional application No. 61/846,682, filed on Jul. 16, 2013.

(51) Int. Cl.

| | |
|---|---|
| ***E04B 1/00*** | (2006.01) |
| ***E04B 2/74*** | (2006.01) |
| ***E04F 13/08*** | (2006.01) |

(52) U.S. Cl.

CPC ..... *E04B 2/7457* (2013.01); *E04F 13/0816* (2013.01); *E04F 13/0819* (2013.01); *E04F 13/0851* (2013.01); *E04F 13/0862* (2013.01); *E04B 2002/7466* (2013.01); *E04B 2002/7498* (2013.01)

(58) Field of Classification Search

CPC ..... E04B 2/7457; E04B 2/721; E04F 13/0864
USPC ..... 52/274, 235, 508, 511, 475.1, 476
See application file for complete search history.

(56) References Cited

U.S. PATENT DOCUMENTS

| | | | | |
|---|---|---|---|---|
| 4,344,267 | A * | 8/1982 | Sukolics | 52/475.1 |
| 4,439,960 | A * | 4/1984 | Jenkins | 52/99 |
| 4,667,579 | A | 5/1987 | Daw | |
| 4,703,598 | A | 11/1987 | Wilson et al. | |

(Continued)

FOREIGN PATENT DOCUMENTS

| | | |
|---|---|---|
| JP | 06-024102 | 3/1994 |
| KR | 20-0399127 | 10/2005 |

(Continued)

OTHER PUBLICATIONS

International Search Report and Written Opinion for corresponding PCT Application No. PCT/US2014/045869, dated Oct. 29, 2014.

*Primary Examiner* — Basil Katcheves
(74) *Attorney, Agent, or Firm* — Gardner, Linn, Burkhart & Flory, LLP

(57) ABSTRACT

A cleanroom wall panel system is provided for defining the perimeter or interior divisions of a cleanroom. The system includes a plurality of elongate retainer elements, which are mounted to wall studs, and a plurality of wall panels with hook portions configured to engage the elongate retainer elements. The retainer elements and/or wall panels may be oriented at either of two different orientations, and further are designed to accommodate some variations in the positioning of the components relative to one another, which facilitates assembly of the wall panel assembly. Each wall panel's weight is supported, either directly or indirectly, by a floor surface located below the wall panel, so that the hook portions are used primarily to secure the wall panels against the retainer elements.

20 Claims, 10 Drawing Sheets

(56) References Cited

U.S. PATENT DOCUMENTS

| | | | | | |
|---|---|---|---|---|---|
| 4,709,517 | A | | 12/1987 | Mitchell et al. | |
| 4,914,880 | A | | 4/1990 | Albertini | |
| 4,999,960 | A | * | 3/1991 | Herwegh et al. | 52/235 |
| 5,067,293 | A | * | 11/1991 | Reynolds | 52/235 |
| 5,159,793 | A | | 11/1992 | Deugo et al. | |
| 5,220,759 | A | * | 6/1993 | Hossli | 52/235 |
| 5,226,274 | A | * | 7/1993 | Sommerstein | 52/512 |
| 5,239,798 | A | * | 8/1993 | Saito | 52/235 |
| 5,263,292 | A | * | 11/1993 | Holland et al. | 52/235 |
| 5,297,370 | A | | 3/1994 | Greenstreet et al. | |
| 5,301,484 | A | * | 4/1994 | Jansson | 52/235 |
| 5,522,193 | A | * | 6/1996 | Sommerstein et al. | 52/235 |
| 5,603,192 | A | | 2/1997 | Dickson | |
| 5,761,908 | A | | 6/1998 | Oas et al. | |
| 5,809,729 | A | * | 9/1998 | Mitchell | 52/474 |
| 5,893,245 | A | * | 4/1999 | Sekiguchi et al. | 52/235 |
| 5,941,040 | A | | 8/1999 | McAnallen et al. | |
| 5,974,573 | A | | 10/1999 | Martin | |
| 6,035,598 | A | * | 3/2000 | Sukolics et al. | 52/506.08 |
| 6,047,508 | A | | 4/2000 | Goodman et al. | |
| 6,065,259 | A | * | 5/2000 | Clear | 52/284 |
| 6,098,364 | A | * | 8/2000 | Liu | 52/506.08 |
| 6,427,408 | B1 | * | 8/2002 | Krieger | 52/489.1 |
| 6,484,465 | B2 | * | 11/2002 | Higgins | 52/474 |
| 6,688,056 | B2 | | 2/2004 | Von Hoyningen Huene et al. | |
| 6,745,527 | B1 | * | 6/2004 | Sherman et al. | 52/235 |
| 6,748,709 | B1 | * | 6/2004 | Sherman et al. | 52/235 |
| 7,096,629 | B1 | * | 8/2006 | Cox | 52/235 |
| 7,478,504 | B2 | | 1/2009 | Huebner et al. | |
| 7,665,250 | B2 | | 2/2010 | Powell | |
| D619,880 | S | * | 7/2010 | MacDonald et al. | D8/354 |
| 7,752,818 | B1 | * | 7/2010 | Roegge et al. | 52/235 |
| 2005/0060950 | A1 | * | 3/2005 | Hauschildt et al. | 52/235 |
| 2007/0119105 | A1 | * | 5/2007 | MacDonald et al. | 52/235 |
| 2009/0313928 | A1 | | 12/2009 | Montgomery | |
| 2010/0186343 | A1 | * | 7/2010 | MacDonald et al. | 52/747.1 |
| 2010/0263314 | A1 | * | 10/2010 | MacDonald et al. | 52/506.05 |
| 2013/0086860 | A1 | | 4/2013 | Solomon et al. | |

FOREIGN PATENT DOCUMENTS

| | | |
|---|---|---|
| KR | 10-2006-0070149 | 6/2006 |
| KR | 10-2009-0056487 | 6/2009 |

* cited by examiner

CLEANROOM WALL PANEL SYSTEM, AND METHOD

CROSS REFERENCE TO RELATED APPLICATION

The present application claims the benefit of U.S. provisional application Ser. No. 61/846,682, filed Jul. 16, 2013, which is hereby incorporated herein by reference in its entirety.

FIELD OF THE INVENTION

The present invention relates generally to cleanrooms and, more particularly, to wall paneling or dividers for use in cleanrooms.

BACKGROUND OF THE INVENTION

Cleanrooms are commonly used in the production of products or components that are sensitive to contaminants such as airborne particulates. For example, electronic circuitry and pharmaceuticals are frequently produced in cleanroom environments equipped with air filtration systems, and in which persons located in the cleanroom typically wear protective garments to limit or prevent contaminants from being introduced by the person(s) into the cleanroom. Other uses for cleanrooms include handling and containing hazardous substances. Some cleanrooms are subject to a regular cleaning process in which most or all of the exposed surfaces in the room are washed to remove contaminants that may have been inadvertently introduced into the room.

SUMMARY OF THE INVENTION

The present invention provides a cleanroom wall panel system that can be used to separate cleanrooms from other areas, or to divide cleanrooms into separate areas, for example. The cleanroom wall panel system includes one or more types of components that can be installed in either of two or more different orientations, and in a manner that allows for some variability in the placement of various components. This enables the system to be assembled relatively quickly and without adversely affecting the performance of the wall panel system.

In one form of the present invention, a cleanroom wall panel system includes at least one elongate retainer element that is attachable to a plurality of wall studs, and at least one wall panel with hook portions defined along a perimeter region thereof. The elongate retainer element has a rearward mounting portion and an upper flange portion, with the rearward mounting portion configured to be coupled to the wall studs, and with the upper flange portion spaced forwardly of the rearward mounting portion. The perimeter region of the wall panel is disposed around a central portion, which is typically a planar sheet portion. The perimeter edge portion includes at least two rearwardly-directed flange portions at opposite sides of the central portion. The rearwardly-directed flange portions are angled relative to the central portion, and the hook portions are arranged along the flange portions. Each of the hook portions defines a recess that is configured to receive the upper flange portion of the elongate retainer element. The wall panel's weight is supported, either directly or indirectly, by a floor surface located below the wall panel. The wall panel is substantially prevented from being pulled or moved away from the wall studs due to engagement of the elongate retainer element's upper flange portion in the recesses defined by the hook portions of the wall panel's rearwardly-directed flanges.

Optionally, the elongate retainer element includes a lower flange portion opposite the upper flange portion and spaced forwardly of the rearward mounting portion. In this arrangement, the upper and lower flange portions may be substantially symmetrical with one another. In this configuration, the elongate retainer element is positionable along the wall studs in either of two orientations in which one of the flange portions is directed upwardly.

Optionally, each of the hook portions is generally T-shaped and defines two of the recesses at opposite ends thereof. In this arrangement, the wall panel is positionable in either of two different orientations in which one of the two recesses of each of the hook portions is directed downwardly.

Optionally, the wall panel system further includes an insulating material (e.g., thermal insulating and/or sound-absorbent material) disposed along a rear surface of the central portion of the at least one wall panel. Optionally, the insulating material may be made from any of: polypropylene honeycomb panels, gypsum board, expanded polystyrene rigid foam insulation sheets, extruded polystyrene, and spray-applied foam.

In another form of the present invention, a method is provided for installing a cleanroom wall panel system, the method includes the steps of (i) attaching an elongate retainer element to the plurality of wall studs that are in spaced arrangement, with the elongate retainer element including (a) a rearward mounting portion for coupling to the wall studs and (b) at least an upper flange portion spaced forwardly of the rearward mounting portion, (ii) positioning a wall panel along the elongate retainer element, the wall panel having a perimeter edge portion disposed around a central portion, with the perimeter edge portion including at least two rearwardly-directed flange portions at opposite sides of the central portion, the rearwardly-directed flange portions being angled relative to the central portion and having a plurality of hook portions, with each of the hook portions at least partially defining a recess with a lower opening, (iii) securing the wall panel to the elongate retainer element by lowering the wall panel so that at least the lower opening of one of the hook portions of each of the rearwardly-directed flange portions receives the upper flange portion of the elongate retainer element, and (iv) further lowering the wall panel until its weight is substantially supported by a floor surface, or by a footer positioned along a floor surface.

Thus, the present invention provides a cleanroom wall panel system that may be readily assembled from relatively few different types of components, some or all of which may be installed in at least two different orientations, and which can tolerate some variation in positioning of the components relative to one another, without adversely affecting the finished system. The finished system may thus be installed quickly and at reduced cost, and without sacrificing quality or performance.

These and other objects, advantages, purposes and features of the present invention will become apparent upon review of the following specification in conjunction with the drawings.

DESCRIPTION OF THE PREFERRED EMBODIMENTS

Figure 1:
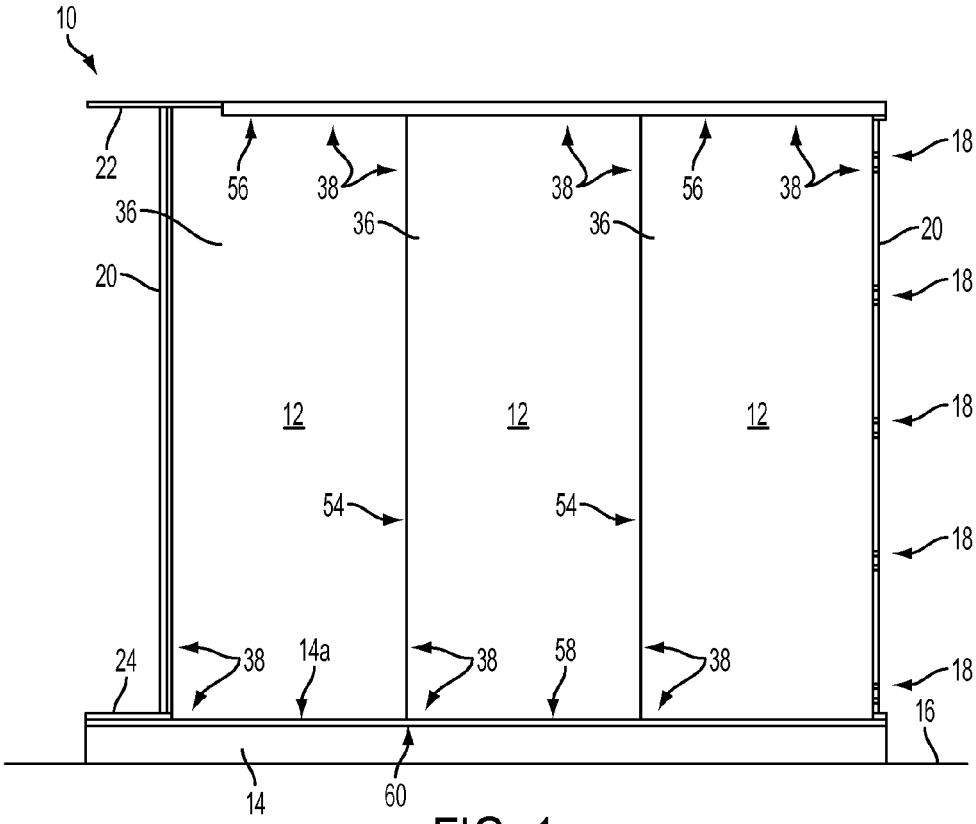
FIG. 1 is a front elevation of a cleanroom wall panel system in accordance with the present invention.

Referring now to the drawings and the illustrative embodiments depicted therein, a cleanroom wall panel system 10 is provided for defining the perimeter or intermediate divider walls of a cleanroom, such as would be used for limiting or preventing contamination of items in the cleanroom, or for limiting or preventing contamination of persons or items locating in the cleanroom by other materials that may be present in the cleanroom. The cleanroom wall panel system 10 includes a plurality of wall panels 12 that are supported along a top surface 14*a* of an elongate footer 14, which is positioned along a floor surface 16 (FIG. 1). Although the weight of wall panels 12 is generally fully supported by footer 14, the wall panels are further coupled to a plurality of elongate retainer elements 18, which in turn are coupled to a plurality of wall studs 20, so that wall panels 12 are supported in an upright position. As will be described in more detail below, wall panels 12 and elongate retainer elements 18 are positionable in either of at least two different orientations for installation, without affecting the functionality or appearance of the completed wall panel system 10.

Figure 4:
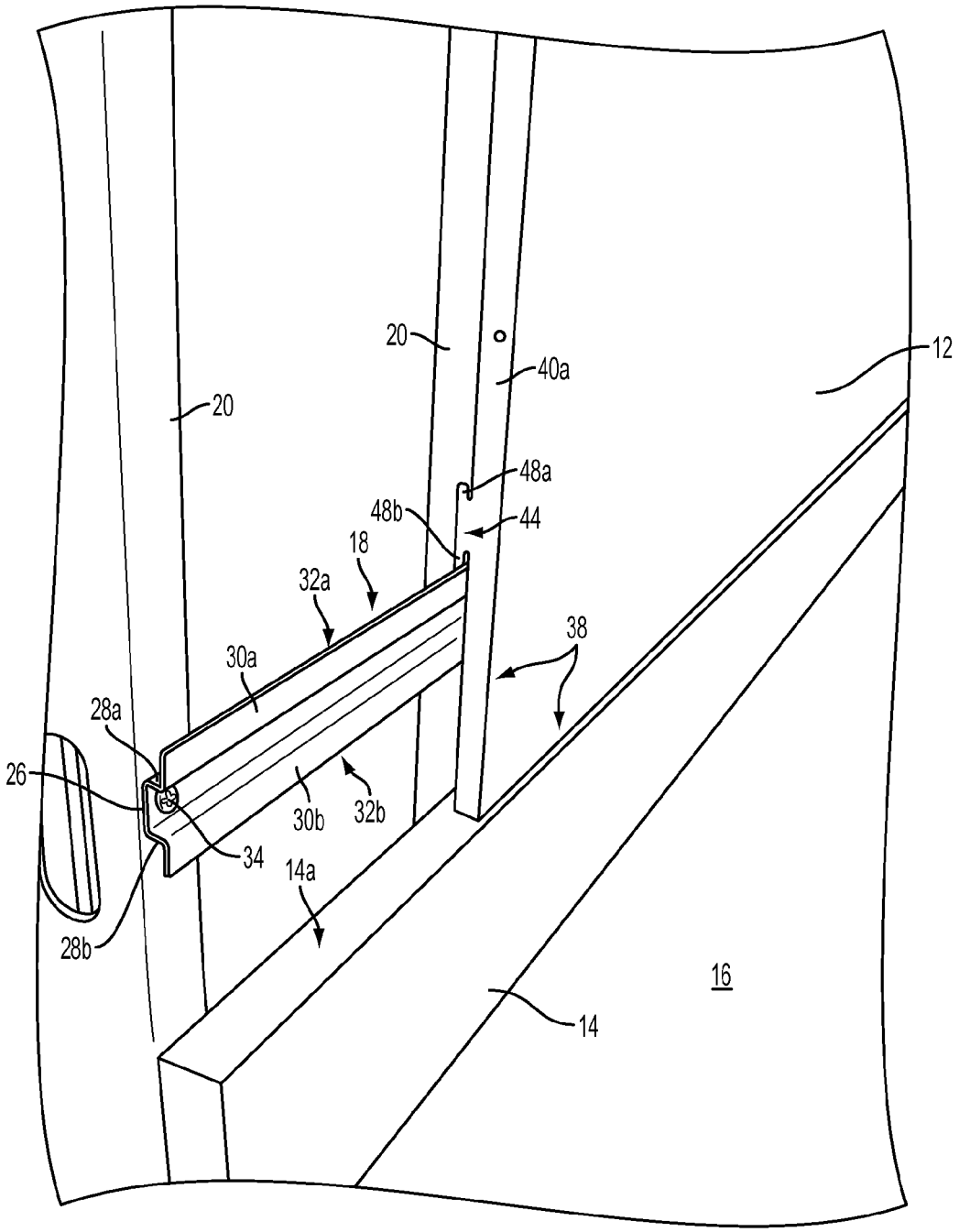
FIG. 4 is a perspective view of a lower portion of a cleanroom wall panel system in accordance with the present invention, in which a front wall panel is removed to show underlying structure.
Figure 5:
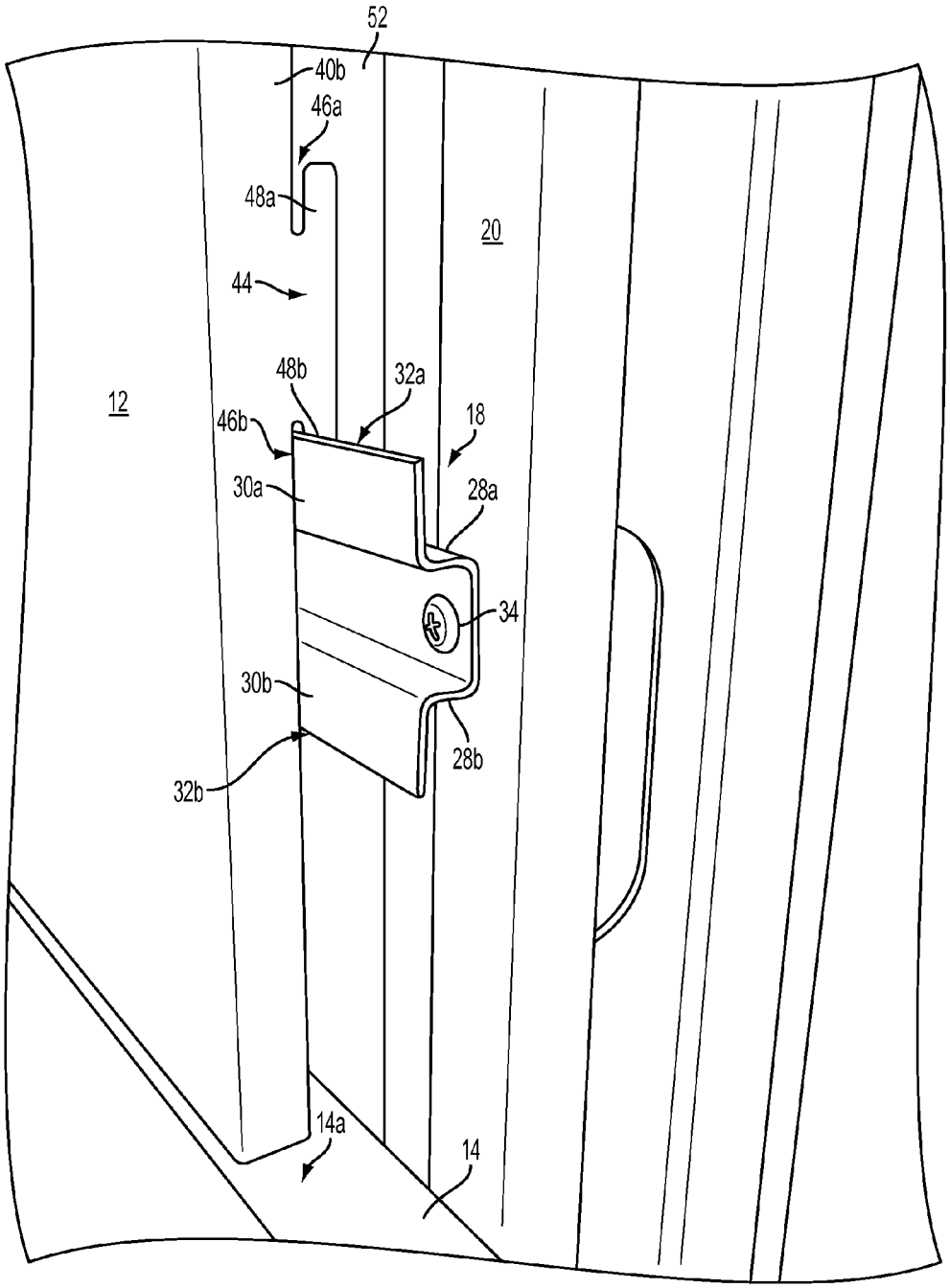
FIG. 5 is another perspective view of a lower portion of the cleanroom wall panel system of FIG. 4, as viewed from an opposite side thereof.
Figure 6:
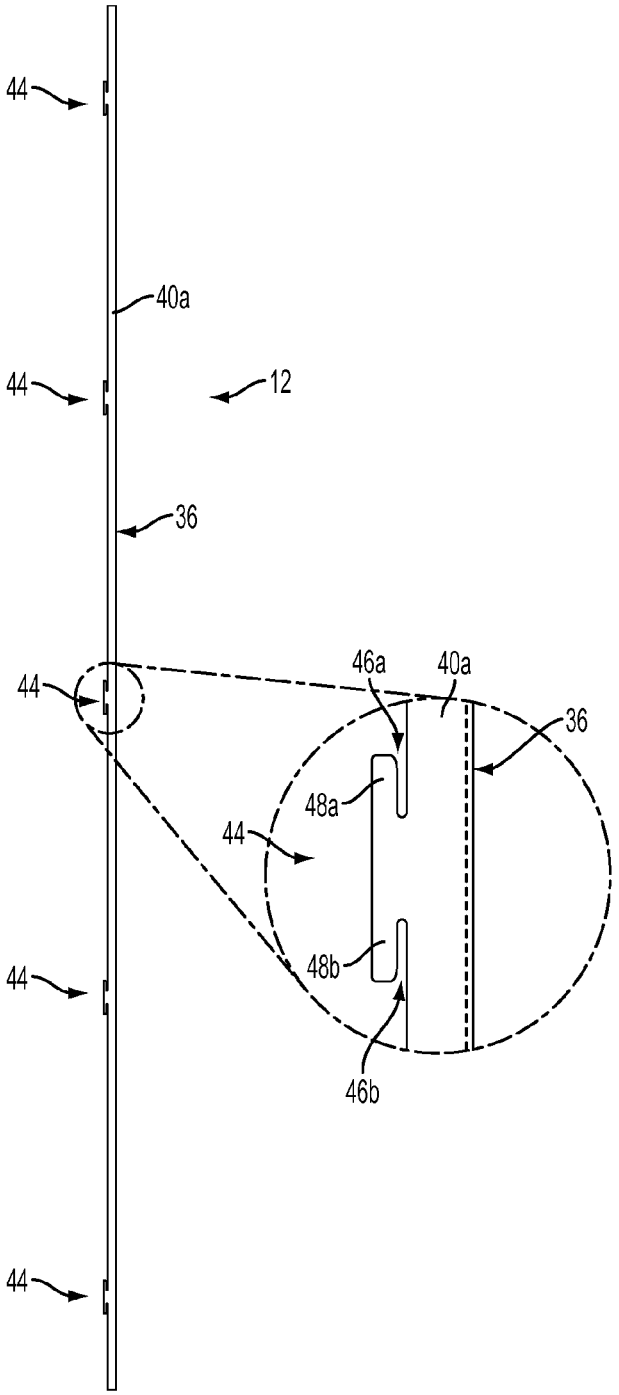
FIG. 6 is a right side elevation of a wall panel that forms part of the cleanroom wall panel system, including an enlarged view of a selected portion thereof.
Figure 7:
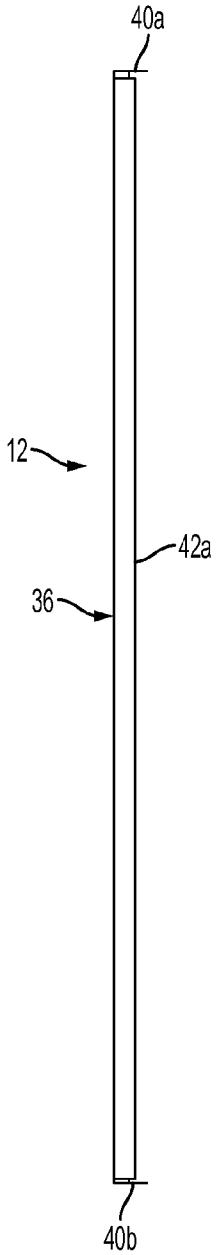
FIG. 7 is a top plan view of the wall panel of FIG. 6.

Wall studs 20 may be substantially conventional metal or wooden studs, which are coupled between a header or cap 22 and a stud footer or base 24, such as shown in FIG. 1. Stud footer 24 may be positioned along a top surface 14*a* of elongate footer 14, such as shown in FIG. 1, or may instead be supported directly on the floor surface 16 behind elongate footer 14, such as shown in FIGS. 4 and 5. Likewise, it is envisioned that elongate footer 14 is an optional feature, such that wall panels could be supported directly on floor surface, such as in the manner described below with reference to FIGS. 15-18, and without departing from the spirit and scope of the present invention.

Figure 3:
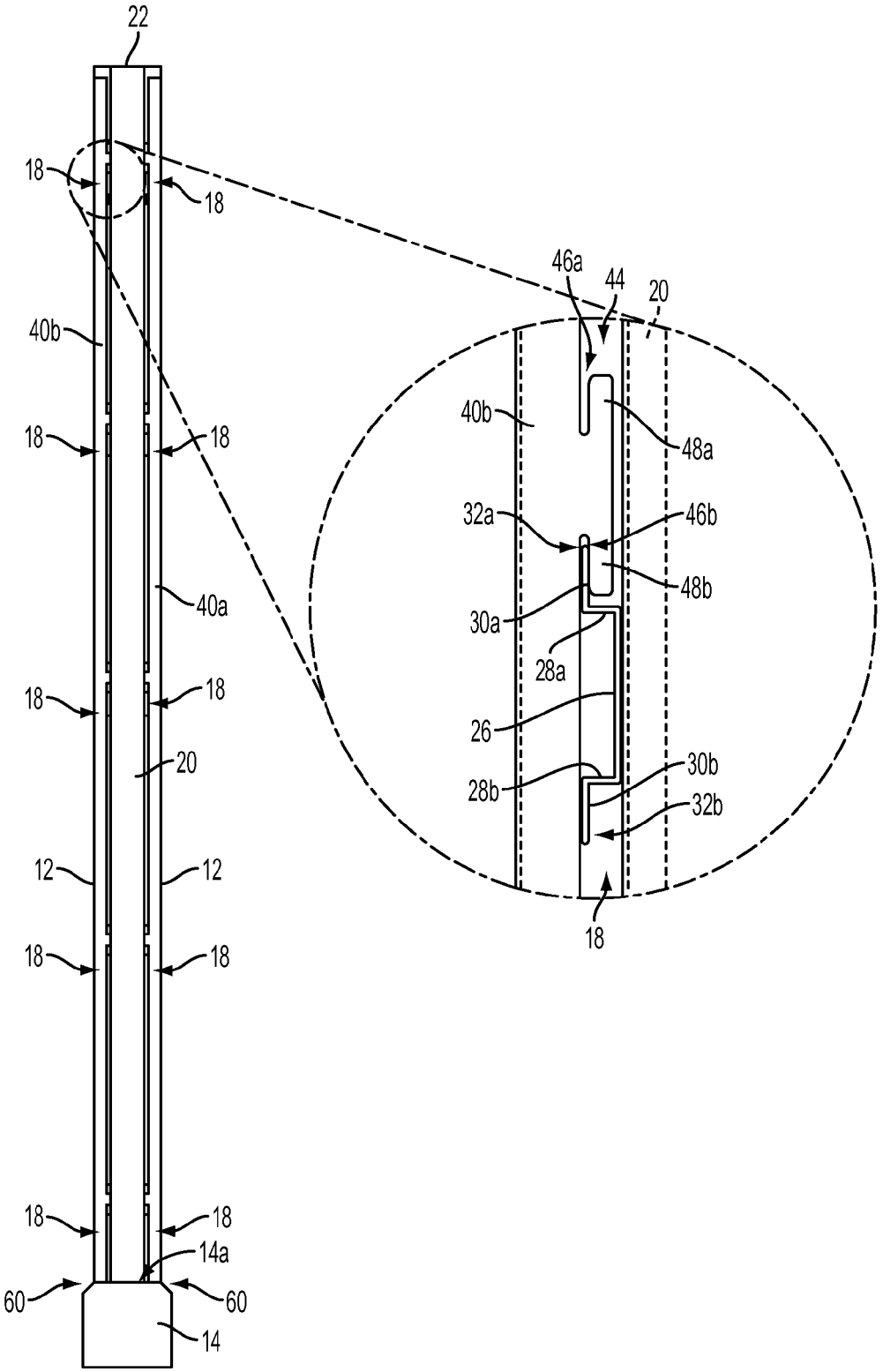
FIG. 3 is a side elevation of the cleanroom wall panel system of FIG. 1, including an enlarged view of a selected portion thereof.

Elongate retainer elements 18 are aligned substantially horizontally, in a vertically-spaced arrangement, such as shown in FIGS. 1 and 3-5. As best shown in FIGS. 3 and 5, each retainer element 18 has a substantially constant cross section that is symmetrical about a horizontal plane through its longitudinal axis, and includes a rearward mounting portion 26, upper and lower web portions 28*a*, 28*b*, and upper and lower flanges or flange portions 30*a*, 30*b*. In the illustrated embodiment, rearward mounting portion 26 is generally planar and aligned in a vertical plane when coupled to wall studs 20, while upper and lower web portions 28*a*, 28*b* are angled forwardly at about 90 degrees relative to rearward mounting portions 26 so as to be substantially horizontal. Upper and lower flanges 30*a*, 30*b* are angled upwardly and downwardly (respectively) at about 90 degrees relative to the respective web portions so as to be substantially vertical, coplanar with one another, and spaced forwardly from rearward mounting portion 26. Thus, each retainer element's rearward mounting portion 26 and upper and lower web portions 28*a*, 28*b* cooperate to form a generally U-shaped cross section, with flanges 30*a*, 30*b* projecting upwardly and downwardly in the installed orientation (or projecting laterally outwardly when rotated to form an upright U-shape). Upper flange 30*a* and lower flange 30*b* each terminates in a respective free end portion 32*a*, 32*b*, opposite the location where each flange joins its respective web portion.

Because retainer elements 18 are substantially symmetrical about their longitudinal axes, they may be positioned along wall studs 20 in either of two different orientations that are rotated about 180 degrees from one another about a horizontal orthogonal axis. If a given retainer element 18 were rotated in that manner, then the flange described and shown herein as "lower flange 30*b*" would actually be directed upwardly, and the flange described and shown herein as "upper flange 30*a*" would be directed downwardly, but it will be appreciated that the appearance and function of retainer element 18 would remain unchanged. Retainer elements 18 are coupled to wall studs 20 via any suitable method, such as with mechanical fasteners (e.g., self-tapping screws 34, such as shown in FIGS. 4 and 5, threaded bolts, rivets, etc.), or via welding or other type of fastening system. In the illustrated embodiment, retainer elements 18 are unitarily formed by bending an elongate sheet metal strip, which may be made of steel or any sufficiently strong material. Optionally, the retainer elements could be formed by an extrusion process (e.g., using metal such as aluminum, or resinous plastic) or other suitable forming method.

Figure 2:
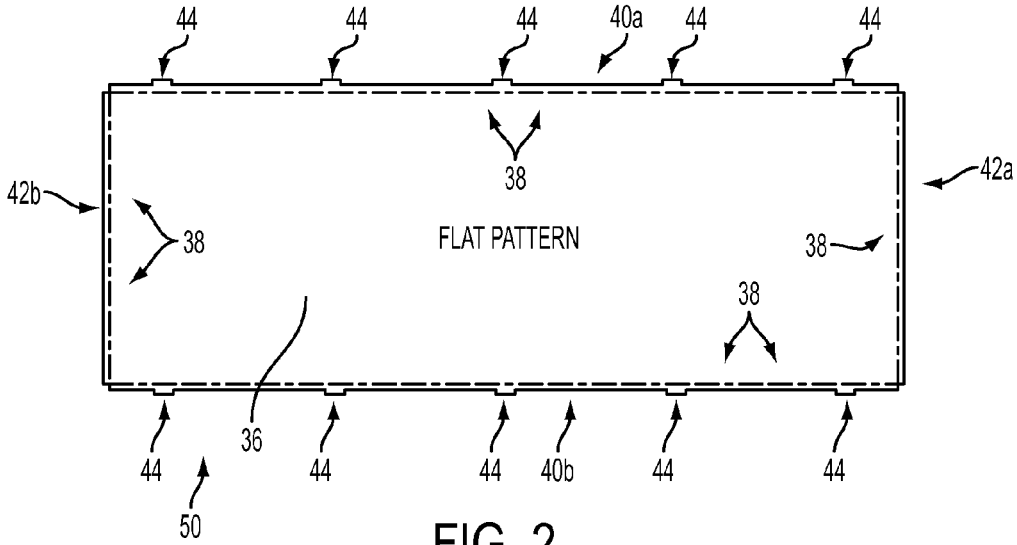
FIG. 2 is a front elevation of a planar sheet that has been cut for use in the wall panel system of FIG. 1, shown prior to a final forming process.

Wall panels 12 each have a substantially planar central portion 36 that is surrounded by a perimeter edge portion or region 38 (FIGS. 1 and 2). Perimeter region 38 includes rearwardly-directed left and right side flanges 40*a*, 40*b*, and rearwardly-directed top and bottom end flanges 42*a*, 42*b*. All of the flanges at perimeter edge region 38 are angled at about 90 degrees relative to central portion 36. Left and right side flanges 40*a*, 40*b* each have a plurality of generally T-shaped hook portions 44 that are sized and shaped to receive one of the flanges 30*a* or 30*b* of one of the elongate retainer elements 18 upon assembly of wall panel system 10. Each T-shaped hook portion 44 defines an upper channel or recess 46*a* between an upper T-flange 48*a* and an adjacent portion of its corresponding side flange 40*a* or 40*b*, and a lower channel or recess 46*b* between a lower T-flange 48*b* and an adjacent portion of its corresponding side flange 40*a* or 40*b*, such as shown in FIG. 3. Similar to elongate retainer elements 18, wall panels 12 may be positioned in either of two different orientations that are rotated about 180 degrees from one another about a horizontal orthogonal axis. If a given wall panel 12 were rotated in that manner, then the recess and T-flange that are shown and described herein as "upper recess 46*a*" and "upper T-flange 48*a*" would actually be directed downwardly, then the recess and T-flange that are shown and described herein as "lower recess 46*b*" and "lower T-flange 48*b*" would actually be directed upwardly, but it will be appreciated that the appearance and function of wall panel 12 would remain unchanged.

Each recess 46*a*, 46*b* of a given T-shaped hook portion 44 is sufficiently long so that upper flange 30*a* of a given retainer element 18 can be partially or fully received in the lower recess 46*b* when wall panel 12 is supported at footer 14 (or supported directly at floor surface 16). Even when upper flange 30*a* is partially received in lower recess 46*b*, such as shown in FIGS. 3-5, lower T-flange 48*b* overlaps upper flange 30*a* sufficiently to secure the wall panel 12 at wall studs 20, via retainer elements 18. As shown in FIG. 3, T-flanges 48*a*, 48*b* and web portions 28*a*, 28*b* are sized so that T-shaped hook portions 44 remain spaced from the wall studs 20 when wall panel 12 is engaged at elongate retainer elements 18. This arrangement helps to ensure that each wall panel 12 may be readily positioned against elongate retainer elements 18, without contact between hook portions 44 and wall studs 20 that could interfere with the proper seating of upper flanges 30 in lower recesses 44*b*.

In the illustrated embodiment of FIG. 3, each T-shaped hook portion 44 engages a corresponding elongate retainer element 18, with the elongate retainer elements 18 evenly spaced above one another and coupled across wall studs 20. However, it is envisioned that fewer elongate retainer elements 18 may be required than are shown, so that not every hook portion 44 would necessarily engage a corresponding retainer element 18. It is generally desirable and preferable that the vertical placement of each elongate retainer element 18 is consistent and sufficiently precise to ensure appropriate engagement of hook portions 44 with corresponding retainer elements 18. However, because the elongate retainer elements 18 are generally not load-bearing and do not require that upper flange 30*a* be fully seated in lower recess 46*b* of the corresponding hook portion 44, wall panel system 10 is tolerant of some variation to the precise placement of each elongate retainer element 18, since such variations will generally only affect the depth to which a given upper flange 30*a* is seated in lower recess 46*b* of the corresponding hook portion 44. For example, flanges 30*a*, 30*b* and recesses 46*a*, 46*b* may be approximately ½-inch in length, and may be accommodate variations in the vertical positioning of each elongate retainer element 18 by about ¼-inch or more.

It will be appreciated that this tolerance typically permits quicker assembly because less time is generally required to place each elongate retainer element 18 when less precision is required. Such dimensional tolerances are generally attainable without requiring undue time for an installation technician to precisely measure and check the positioning of each elongate retainer element 18 prior to attaching it to the corresponding wall studs 20. In addition, it is envisioned that a jig could be readily prepared that would rest on footer 14 (or on floor surface 16) and have retainer element supports positioned at correctly-spaced intervals corresponding to the spacing of T-shaped hook portions 44. Such a jig could be used to hold each of the elongate retainer elements 18 in correct alignment along the wall studs 20 of a given wall section, and then could be removed after all of the retainer elements 18 in that section have been fastened to the studs 20. Optionally, retainer elements 18 may be positioned somewhat higher than shown, so that upper flanges 30*a* are fully engaged in lower recesses 46*b*, and in that case retainer elements 18 would bear some or all of the weight of each wall panel 12.

Each wall panel 12 may be unitarily formed from a single rectangular blank of sheet metal or other suitable material such as fiberglass, resinous plastic, or the like, which is then cut (such as by die-cutting, laser-cutting, machining, or the like) to form a generally planar intermediate panel 50 (FIG. 2) in which corners are removed from the rectangular blank to separate side flanges 40*a*, 40*b* from top and bottom flanges 42*a*, 42*b*, and in which T-shaped hook portions 44 are formed or established at side flanges 40*a*, 40*b*. Each side flange 40*a*, 40*b* and the top and bottom flanges 42*a*, 42*b* may be bent rearwardly (e.g., along the dashed lines in FIG. 2) at about 90 degrees to form the finished wall panel 12. Optionally, the wall panels could be molded or manufactured using other techniques.

Although only left and right side flanges 40*a*, 40*b* include T-shaped hook portions 44 in the illustrated embodiment, it is envisioned that top flange 42*a* and/or bottom flange 42*b* may also be formed with T-shaped hook portions, which would allow the resulting wall panel to be oriented horizontally (i.e., with its long dimension arranged horizontally). Such wall panels could be stacked vertically to achieve the desired height of the finished wall panel system. It is further envisioned that each wall panel may have a different shape, such as square, or rectangles of varying dimensions, to fit the needs of a particular cleanroom or other space. The wall panels may even have non-planar shapes, such as for use in a curved wall or at a bend or corner. In addition, the hook portions could be separate elements that are attached to the wall panel prior to installation, and could be of different shapes, such as generally L-shaped hook portions. However, the use of L-shaped hook portions may limit or prevent a wall panel from being installed in more than one orientation.

Optionally, and as shown in FIG. 5, a thermal and/or sound insulating panel 52 may be applied to a rear surface of each wall panel 12. In the illustrated embodiment, insulating panel 52 is a honeycomb panel made of polypropylene, such as is available from Plascore, Inc. of Zeeland, Mich. Insulating panel 52 may be attached to the rear surface of each wall panel 12 via an adhesive such as double-sided adhesive tape or film, glue, or the like, or may be attached via other fasteners such as magnets, hook-and-loop fasteners, spring clips or clamps, or the like. Optionally, the sound-absorbent panel may be a non-outgassing, non-shedding gypsum board panel (such as DensArmor Plus® brand gypsum-based panels, available from Georgia-Pacific Gypsum LLC), sheets of expanded polystyrene foam insulation, extruded polystyrene, or the like. It is further envisioned that a foam insulating material may be spray-applied to the rear surface of each wall panel 12, and cured to a hardened or semi-hardened state.

After assembly of the wall panels 12 along retainer elements 18, header 22 may be installed atop wall studs 20 and wall panels 12 in a manner that covers top flanges 42*a*. A sealant material, such as an anti-microbial caulk, may be applied to all exposed joints, in order to limit or prevent undesired airflow between the cleanroom and other areas, and to limit or avoid the formation of crevices, sharp corners, or other areas that may be difficult to clean and/or may be prone to collecting airborne contaminants. For example, caulk or other sealant may be applied to substantially vertical joints or joint regions 54 between adjacent wall panels 12, at horizontal joints or joint regions 56 between header 22 and wall panels 12, and at horizontal joints or joint regions 58 between elongate footer 14 and wall panels 12, such as shown in FIG. 1. In addition, sealant may be applied between header 22 and ceiling panels in the cleanroom, and between footer 14 and floor surface 16. To further enhance cleanability and reduce the system's propensity to collect contaminants, footer 14 may be formed with chamfered upper corners 60, such as shown in FIG. 3, and a washable and/or anti-microbial paint or other surface treatment may be applied to wall panels and caulked joints.

Assembly of cleanroom wall panel system 10 is accomplished by first installing footers 14 and/or wall studs 20 if needed and/or desired. The elongate retainer elements 18 are then coupled to the wall studs 20 in vertically-spaced arrangement, with either of the flanges 30*a*, 30*b* directed upwardly. The wall panels 12 may be pre-formed according to known dimensions and delivered to the installation site, or may be formed on-site. Once formed to the desired dimensions, wall panels 12 are initially positioned along the elongate retainer elements 18 with the free end portions 32*a* of upper flanges 30*a* positioned just below the lower recesses 46*b* that are formed by T-shaped hook portions 44 of the left and right side flanges 40*a*, 40*b*. Each wall panel 12 is secured to the elongate retainer elements 18 by lowering the wall panel 12 so that portions of upper flanges 30*a* (including free end portions 32*a*) are received in the lower recesses 46*b* of T-shaped hook portions 44. The wall panel 12 is further lowered until its weight is supported directly by the floor surface 16, or by the upper surface 14*a* of footer 14.

Optionally, adjacent wall panels 12 may then be secured together via clamps or other mechanical fasteners such as threaded screws or bolts, rivets, welds, or the like. Upon installation of the wall panels 12, header 22 is installed and sealant is applied to exposed joints or joint regions, such as describe above. The assembly may be finished with paint or other surface treatment, such as washable and/or anti-microbial paint. Optionally, wall panels 12 may be constructed from galvanealed 20-gauge steel with any epoxy powder coat, although other materials (including nonmetals) and coatings are envisioned.

It is further envisioned that the wall panel system may be readily disassembled and removed, and even reassembled and reused, by removing or cutting through any sealant, lifting the wall panels off of the retainer elements, and detaching the retainer elements from the wall studs. In the illustrated embodiments, substantially any individual panel can be removed to provide access to an area behind the wall panel, such as for accessing mechanical and electrical components that may be located in spaces behind the individual wall panels, which can generally be accomplished without removing adjacent panels. It will be appreciated that the sizes and shapes of some panels may be customized as desired, such as to provide a smaller and more easily removable and replaceable panel over an area in which electrical junction boxes, fluid valves, or other components are located within a given wall.

Figure 8:
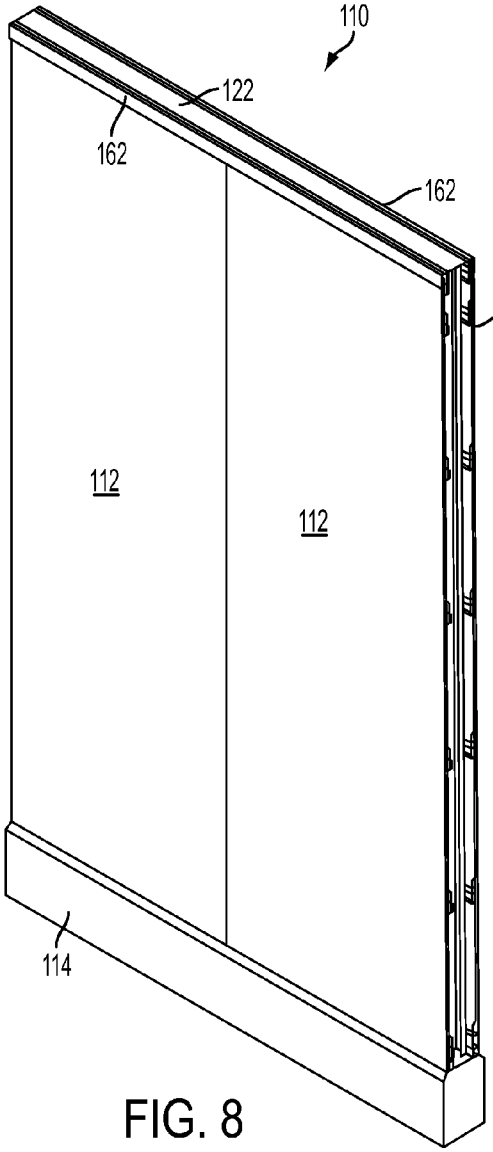
FIG. 8 is a perspective view of a portion of another cleanroom wall panel system in accordance with the present invention.
Figure 9:
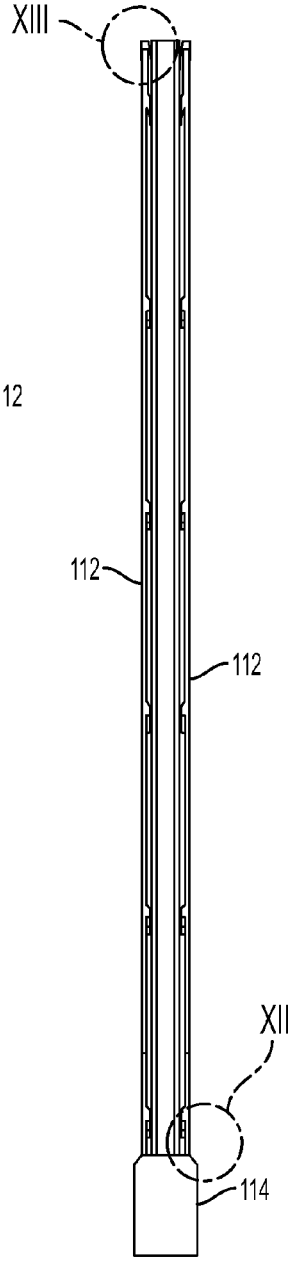
FIG. 9 is an end elevation of the cleanroom wall panel system of FIG. 8.
Figure 10:
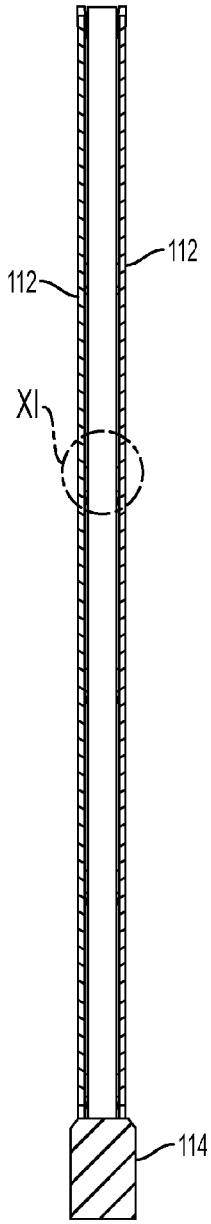
FIG. 10 is a sectional end elevation of the cleanroom wall panel system of FIG. 8.
Figure 11:
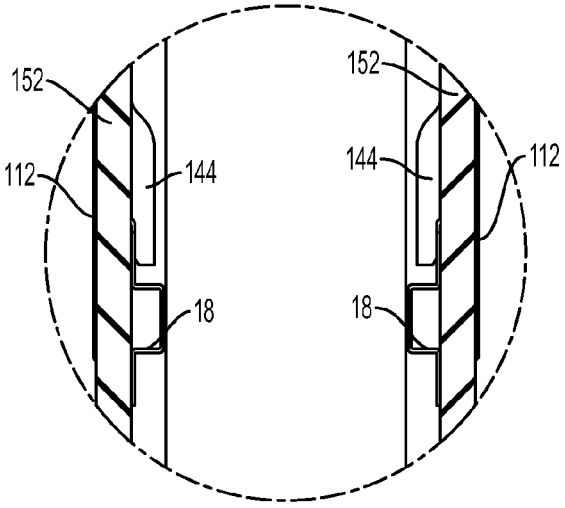
FIG. 11 is an enlarged view of the area designated XI in FIG. 10.
Figure 12:
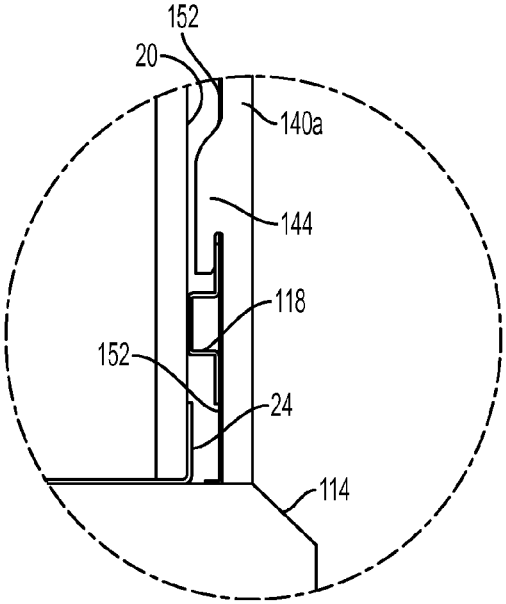
FIG. 12 is an enlarged view of the area designated XII in FIG. 9.

It will be appreciated that the cleanroom wall panel systems need not include wall panels or other components that are reversible so as to be installed in either of two or more orientations. For example, and with reference to FIGS. 8 and 14, another cleanroom wall panel system 110 is similar to the system 10 described above. Wall panel system 110 includes wall panels 112 having respective left and right side flanges 140*a*, 140*b* (FIGS. 9 and 11) that define pluralities of generally L-shaped hook portions 144, such as shown in FIGS. 11 and 12. The various other components of wall panel system 110 may be the same or substantially the same as those described above, such as insulating panels 152 and elongate retainer elements 18. The wall panels 112 are retained in position relative to wall studs 20 via engagement of hook portions 144 with elongate retainer elements 18, and the weight of walls panels 112 is entirely or substantially supported by an elongate footer 114. Optionally, insulating panels 152 may protrude slightly rearwardly of side flanges 140*a*, 140*b* of wall panel 112, so that elongate retainer elements 18 will contact (and may compress) insulating panels 152 near and below the location of each hook portion 144, such as shown in FIG. 12. This arrangement helps to ensure a tight fit of the retainer elements' upper flange portions with the recesses or channels formed by the hook portions 144, and may reduce the likelihood that a given wall panel will vibrate, buzz, or rattle in response to vibrations or noises in the vicinity.

Figure 13:
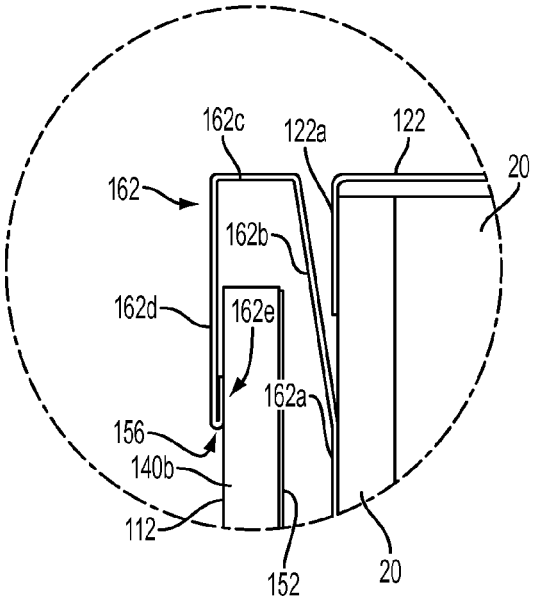
FIG. 13 is an enlarged view of the area designated XIII in FIG. 9.
Figure 14:
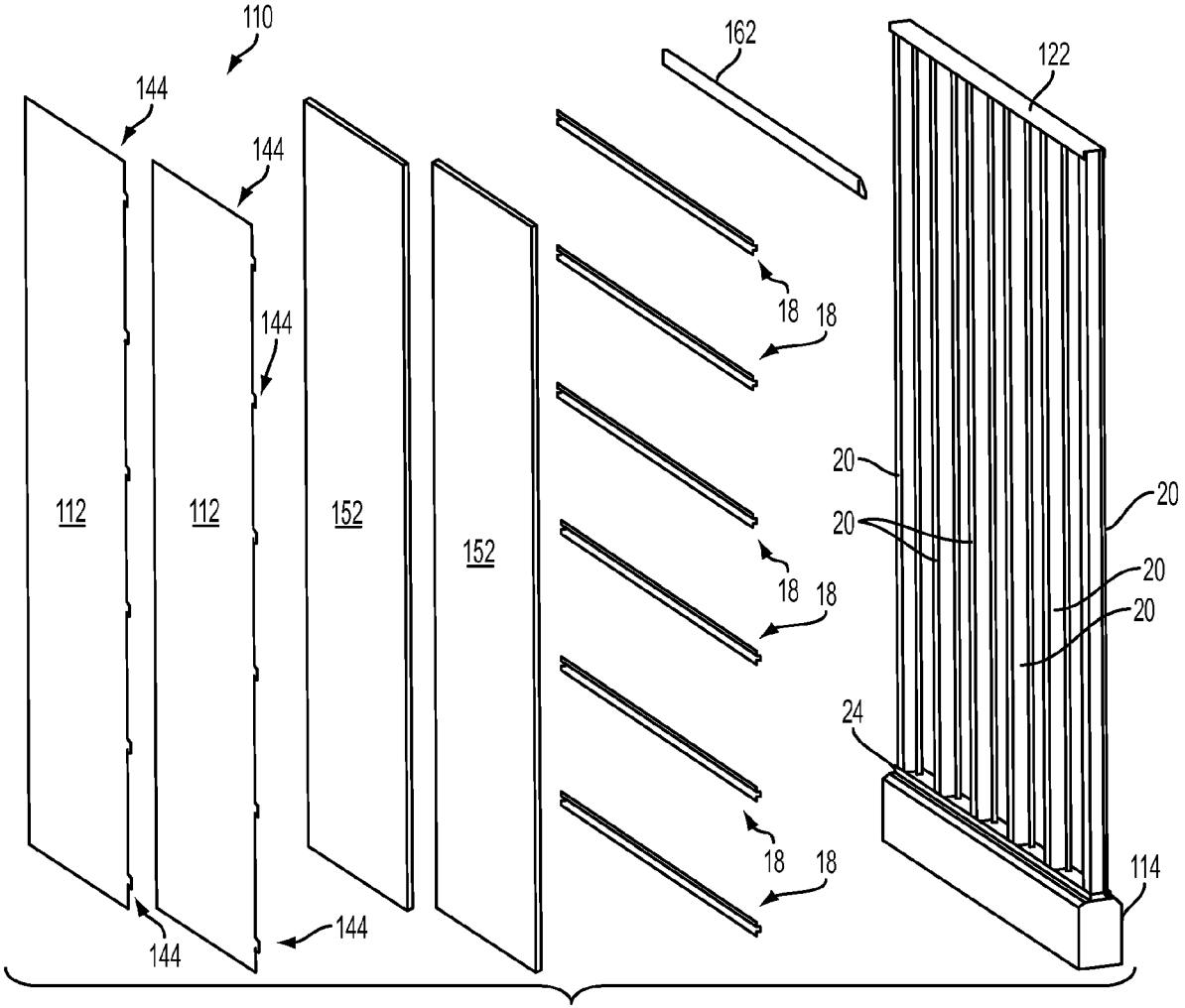
FIG. 14 is an exploded perspective view of the cleanroom wall panel system of FIG. 8.
Figure 15:
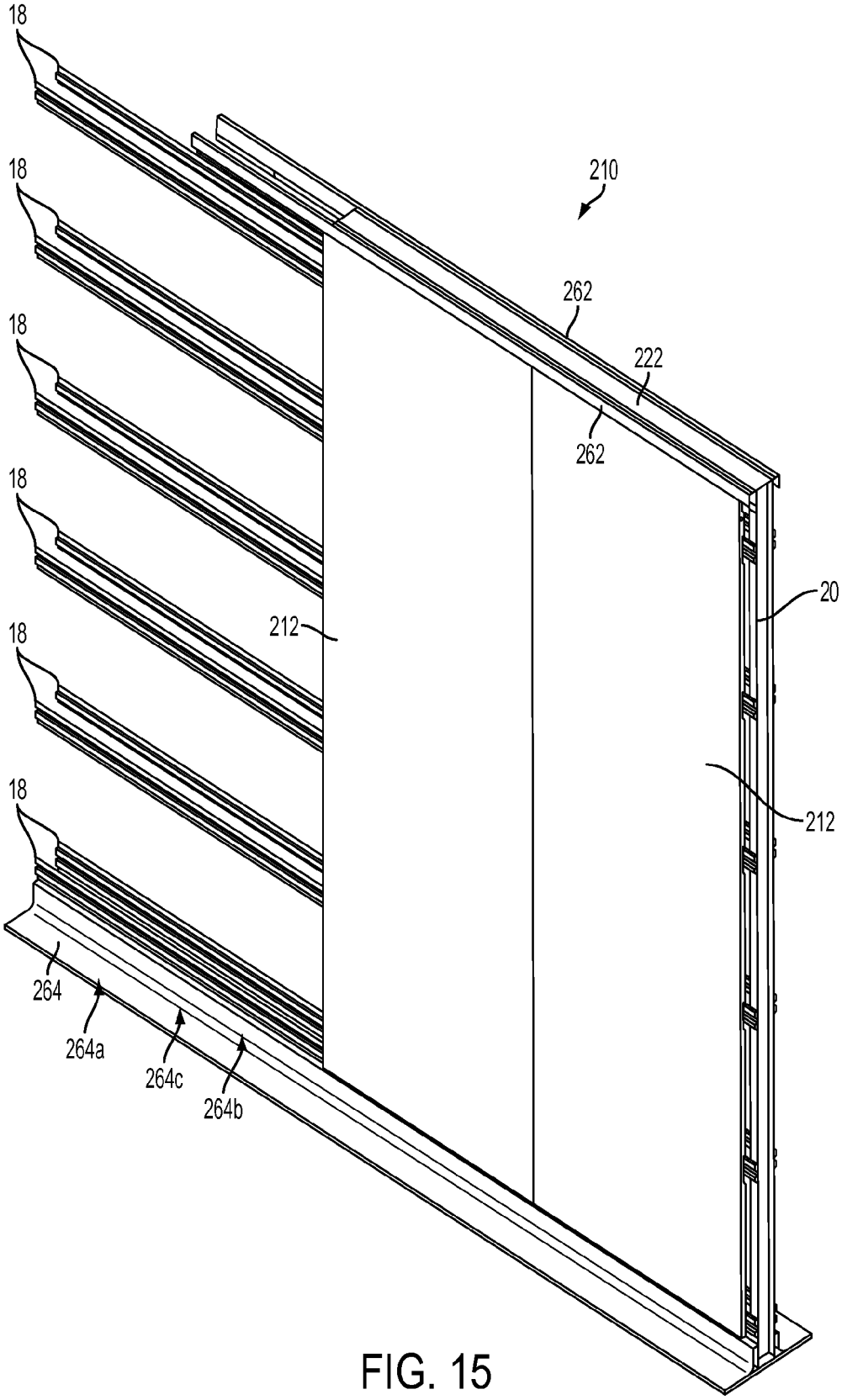
FIG. 15 is a perspective view of a portion of another cleanroom wall panel system in accordance with the present invention.
Figure 16:
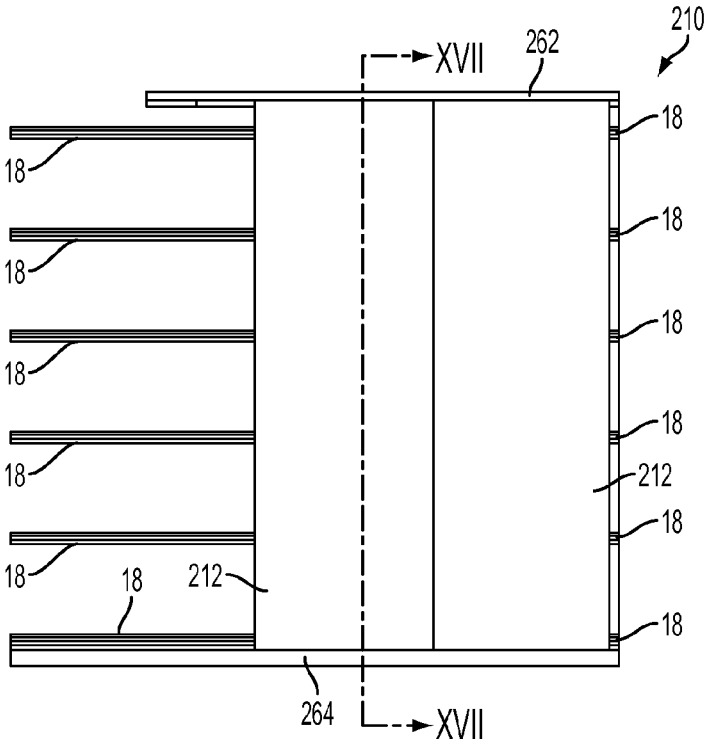
FIG. 16 is a front elevation of the portion of the cleanroom wall panel system of FIG. 15.
Figure 17:
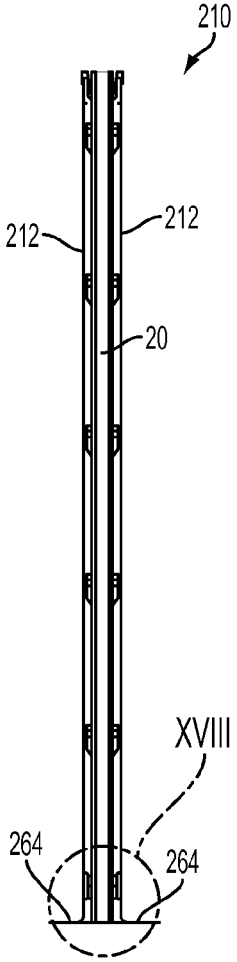
FIG. 17 is an end sectional elevation taken along line XVII-XVII in FIG. 16.

Wall studs 20 are supported between a header cap 122 and a stud footer or base 24. In the illustrated embodiment of FIGS. 8-14, and as best shown in FIGS. 13 and 14, an additional ceiling track 162 is coupled across wall studs 20 and spaced above the uppermost elongate retainer element 18, and projects forwardly of header cap 122. Ceiling track 162 engages or is received by a ceiling surface of the cleanroom, with the junction between ceiling track 162 and the ceiling surface being sealable with caulking or the like. Ceiling track 162 includes a mounting portion 162*a* (FIG. 13) that may be attached to wall studs 20 via welding, bonding, or mechanical fasteners such as screws, rivets, bolts, or the like. A forwardly-sloped portion 162*b* projects upwardly and is angled forwardly from mounting portion 162*a*, passing in front of a vertical flange portion 122*a* of header cap 122. A substantially horizontal upper portion 162*c* extends forwardly from an upper edge of forwardly-sloped portion 162*b*, and a substantially vertical forward portion 162*d* extends downwardly from a forward edge of horizontal upper portion 162*c*, passing in front of an upper edge portion of wall panel 112. Optionally, a bottom end portion 162*e* is folded over itself to provide a smooth edge where ceiling track 162 engages wall panel 112 to form a joint 156 that may then be caulked or sealed.

Optionally, the cleanroom wall panel system may include a panel-to-floor interface in which a separate curb is omitted. For example, and with reference to FIGS. 15-18, a cleanroom wall panel system 210 is similar in many respects to the systems 10, 110 described above, but utilizes a repositionable footer with readily cleanable panel-to-floor transition. Wall panel system 210 includes wall panels 212 having respective left and right side flanges 240*a*, 240*b* (FIG. 18) that define pluralities of generally L-shaped hook portions 244. The various other components of wall panel system 210 may be the same or substantially the same as those described above, such as insulating panels (not shown), header cap 222, ceiling track 262, and elongate retainer elements 18. The wall panels 212 are retained in position relative to wall studs 20 via engagement of hook portions 244 with elongate retainer elements 18, and the weight of walls panels 212 is entirely or substantially supported by respective formed-metal footers 214.

Figure 18:
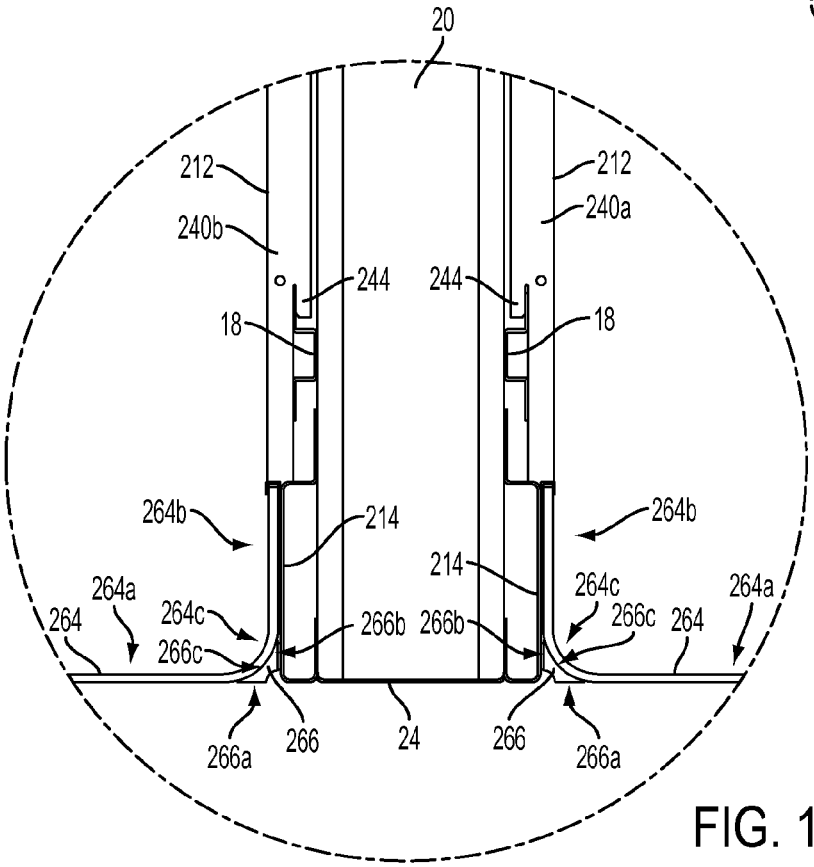
FIG. 18 is an enlarged view of the area designated XVIII in FIG. 17.

A flexible flooring cover 264 is applied so as to have a horizontal portion 264*a* along a floor surface, an upright or vertical portion 264*b* along an outer or forward surface of a respective footer 214, and a curved transition region 264*c* between the horizontal portion 264*a* and the upright portion 264*b* (FIG. 18). Flooring cover 264 provides a smooth, gradual transition from a horizontal floor surface to a generally vertical or upright wall surface, and thus facilitates cleaning while also minimizing areas that can readily trap undesirable contaminants. Flooring cover 264 may extend substantially across a room, and may be sealed to additional sections of flooring coverings to cover the flooring of substantially any desired room.

Optionally, and as shown in FIG. 18, curved transition region 264*c* is supported by a cove trim piece 266 having a downwardly-facing lower horizontal surface 266*a* that engages the floor surface, a rearwardly-facing upright vertical surface 266*b* that engages the footer 214, and a concave outer or forward surface 266*c* that is engaged by curved transition region 264*c* of flexible flooring cover 264. It is envisioned that cove trim piece 266 may be bonded to the floor, to footer 214, and to flooring cover 264, as desired.

An optional cap 268, generally in the shape of an inverted-J when installed as shown in FIG. 18, is positioned at the upper end of upright portion 264*b* of flooring cover 264. Cap 268 includes a rear vertical leg 268*a* that extends downwardly and rests against footer 214, an upper horizontal leg 268*b* that abuts or lies in close proximity to a lower edge of wall panel 212, and a forward vertical leg 268*c* that extends downwardly and covers an upper edge region of upright portion 264*b* of flooring cover 264. Cap 268 may be adjustable or repositionable relative to flooring cover 264 to facilitate minimizing gaps between flooring cover 264, wall panel 212, and footer 214. It is further envisioned that cap 268 may be bonded to one or more of flooring cover 264, footer 214, and wall panel 212 once the desired positioning of these components has been set. Flooring cover 264 may also be bonded to the floor and to footer 214.

Therefore, the present invention provides a cleanroom wall panel system that can be assembled relatively quickly in the construction of a cleanroom, or to divide cleanrooms into separate areas. The cleanroom wall panel system also facilitates disassembly and reassembly of the components to change the configuration of a given area. The wall panels and the elongate retainer elements can be positioned in either of at least two different orientations to facilitate assembly, and the design is tolerant of some variation in the positioning of at least the retainer elements, which may further reduce the time and cost required for installation, without detriment to quality or performance of the finished system. The wall panel system may also be disassembled and re-used in whole or in part, particularly if removable fasteners are used in its assembly.

Changes and modifications to the specifically described embodiments may be carried out without departing from the principles of the present invention, which is intended to be limited only by the scope of the appended claims, as interpreted by the principles of patent law including the doctrine of equivalents.

The embodiments of the invention in which an exclusive property is claimed are defined as follows:

1. A cleanroom wall panel system comprising:

at least two elongate retainer elements each having a rearward mounting portion and an upper flange portion having a free end, wherein said rearward mounting portion is configured to be coupled to at least two elongate studs that are in spaced arrangement, and wherein said upper flange portion is spaced forwardly of said rearward mounting portion;

at least one wall panel having a perimeter edge portion disposed around a central portion, said perimeter edge portion comprising at least two rearwardly-directed flange portions at opposite sides of said central portion, said flange portions being angled relative to said central portion;

a plurality of hook portions defined at said rearwardly-directed flange portions, each of said hook portions at least partially defining a recess that is configured to receive said upper flange portion of a respective one of said elongate retainer elements; and wherein said at least one wall panel contacts and is supported by a floor surface or footer located below said wall panel, and wherein said wall panel is supported at the floor surface or footer so that said wall panel is substantially retained at the elongate studs upon engagement of said upper flange portions in said recesses with gaps defined above said free ends of said upper flange portions and below respective upper ends of said recesses.

2. The wall panel system of claim 1, wherein said elongate retainer elements comprise respective lower flange portions opposite said upper flange portions and spaced forwardly of said rearward mounting portions.

3. The wall panel system of claim 2, wherein said upper and lower flange portions are substantially symmetrical with one another, whereby said elongate retainer elements are positionable along the elongate studs in either of two orientations in which one of said upper and lower flange portions is directed upwardly.

4. The wall panel system of claim 3, wherein said elongate retainer elements further comprise upper and lower web portions disposed between said rearward mounting portion and respective ones of said upper and lower flange portions.

5. The wall panel system of claim 4, wherein said upper and lower flange portions are substantially coplanar with one another, and substantially parallel to said rearward mounting portion, and wherein said upper and lower web portions are substantially perpendicular to said rearward mounting portions and said upper and lower web portions.

6. The wall panel system of claim 4, wherein said rearward mounting portions are unitarily formed with respective ones of said upper and lower flange portions, and said upper and lower web portions.

7. The wall panel system of claim 1, wherein each of said hook portions is generally T-shaped and defines two of said recesses at opposite ends thereof, whereby said wall panel is positionable in either of two different orientations in which one of said two recesses of each of said hook portions is directed downwardly.

8. The wall panel system of claim 7, wherein said hook portions, said rearwardly-directed flange portions, and said central portion of said wall panel are unitarily formed.

9. The wall panel system of claim 1, wherein each of said hook portions is generally L-shaped and defines said recess at a lower end thereof.

10. The wall panel system of claim 1, further comprising a sound-absorbent material disposed along a rear surface of said central portion of said at least one wall panel.

11. The wall panel system of claim 10, wherein said sound-absorbent material comprises at least one chosen from: (i) polypropylene honeycomb panels, (ii) gypsum board, (iii) expanded polystyrene rigid foam insulation sheets, (iv) extruded polystyrene, and (v) spray-applied foam.

12. The wall panel system of claim 1, further comprising a plurality of said wall panels in side-by-side arrangement.

13. The wall panel system of claim 12, further comprising a sealant applied to a joint region between adjacent ones of said wall panels.

14. The wall panel system of claim 1, wherein the at least two wall studs are oriented substantially vertically and said elongate retainer elements are oriented substantially horizontally.

15. The wall panel system of claim 1, further comprising an elongate footer configured to be supported at the floor surface, and wherein said at least one wall panel is supported on said elongate footer.

16. The wall panel system of claim 1, wherein said central portion of said at least one wall panel is substantially planar.

17. The wall panel system of claim 1, wherein said perimeter edge portion of said at least one wall panel further comprises upper and lower rearwardly-directed flange portions at opposite ends of said central portion.

18. The wall panel system of claim 1, wherein said at least one wall panel is directly supported by the floor surface located below said wall panel.

19. A cleanroom wall panel system comprising:

an elongate footer configured to be supported at a floor surface;

a plurality of wall studs oriented substantially vertically and in horizontally-spaced arrangement;

a plurality of elongate retainer elements, each having a rearward mounting portion and at least one flange portion having a free end, wherein said rearward mounting portion is coupled to said elongate studs, and wherein said flange portion is spaced forwardly of said rearward mounting portion;

a plurality of wall panels in side-by-side arrangement, each of said wall panels having a respective perimeter edge portion disposed around a central portion, wherein said perimeter edge portion comprises at least two rearwardly-directed flange portions at opposite sides of said central portion, said rearwardly-directed flange portions being angled relative to said central portion; and a plurality of hook portions defined at said rearwardly-directed flange portions, each of said hook portions defining at least one recess that is configured to receive said flange portion of one of said elongate retainer elements;

wherein said elongate retainer elements are attached to said wall studs with said flange portions directed upwardly;

wherein said wall panels are positionable with one of said recesses directed downwardly for partially receiving said flange portions in said recesses; and wherein said wall panels contact said elongate footer so that the weight of said wall panels is supported by said elongate footer, and said wall panels are substantially retained along the elongate studs upon engagement of said flange portions in said recesses of said hook portions with gaps defined above said free ends of said flange portions and below respective upper ends of said recesses.

20. A method of installing a cleanroom wall panel system, said method comprising:

attaching an elongate retainer element to a plurality of wall studs that are in spaced arrangement, wherein the elongate retainer element includes a rearward mounting portion configured for coupling to the wall studs and at least an upper flange portion spaced forwardly of the rearward mounting portion;

positioning a wall panel along the elongate retainer element, the wall panel having a perimeter edge portion disposed around a central portion, wherein the perimeter edge portion comprises at least two rearwardly-directed flange portions at opposite sides of the central portion, the rearwardly-directed flange portions being angled relative to the central portion and having a plurality of hook portions defined thereat, with each of the hook portions at least partially defining a recess with a lower opening;

securing the wall panel to the elongate retainer element by lowering the wall panel so that at least the lower opening of one of the hook portions of each of said rearwardly-directed flange portions partially receives the upper flange portion of the elongate retainer element; and further lowering the wall panel until the wall panel contacts and is substantially supported by either a floor surface, or by an elongate footer positioned along a floor surface, with the lower openings of the hook portions receiving the upper flange portion of the elongate retainer element with a gap defined above a free end of the upper flange portion and below respective upper ends of the recesses.

* * * * *